United States Patent [19]

Petersen

[11] Patent Number: 4,632,658

[45] Date of Patent: Dec. 30, 1986

[54] APPARATUS WITH BURNER AND HEAT EXCHANGER

[75] Inventor: Jørgen H. Petersen, Nordborg, Denmark

[73] Assignee: Danfoss A/S, Nordborg, Denmark

[21] Appl. No.: 756,596

[22] Filed: Jul. 19, 1985

Related U.S. Application Data

[63] Continuation of Ser. No. 550,376, Nov. 11, 1983, abandoned.

[30] Foreign Application Priority Data

Nov. 24, 1982 [DE] Fed. Rep. of Germany ..... 3243399

[51] Int. Cl.[4] ..... F23D 11/44

[52] U.S. Cl. ..... 431/208; 431/187; 431/115

[58] Field of Search ..... 431/208, 215, 187, 183, 431/173, 171, 115, 116, 350

[56] References Cited

U.S. PATENT DOCUMENTS

| | | | |
|---|---|---|---|
| 2,480,255 | 8/1949 | Mortson et al. | 431/187 |
| 2,904,417 | 9/1959 | TeNuyl | 431/183 |
| 4,318,689 | 3/1982 | Forster et al. | 431/208 |

FOREIGN PATENT DOCUMENTS

| | | | |
|---|---|---|---|
| 1165169 | 9/1969 | United Kingdom | 431/350 |

*Primary Examiner*—Samuel Scott
*Assistant Examiner*—H. A. Odar
*Attorney, Agent, or Firm*—Wayne B. Easton

[57] ABSTRACT

The disclosure relates to an apparatus having a burner and a heat exchanger wherein between a hollow cylinder provided with an end wall and a concentric insert there is formed an annular gap which is free from integers and in which the combustion gases flow from the burner to the outlet. The object is to provide apparatus which permits a starting phase with a pure flame and without pulsations and wherein at the same time the lower power limit can be considerably reduced. This object is achieved by providing in the end of the insert facing the end wall with an annular end wall and a central burner for gasified liquid or gaseous fuel centrally disposed in the insert. A burner having a heatable central fuel preparing chamber and a passage system for the air of combustion with a concentric mouth, and a burner tube as an extension of the insert terminates at a spacing from the end wall of the hollow cylinder. In this construction, the fuel can be burnt stoichiometrically free from soot, forms a stable flame free from pulsations and rapidly brings the burner head to high temperatures.

15 Claims, 2 Drawing Figures

APPARATUS WITH BURNER AND HEAT EXCHANGER

Figure 1:
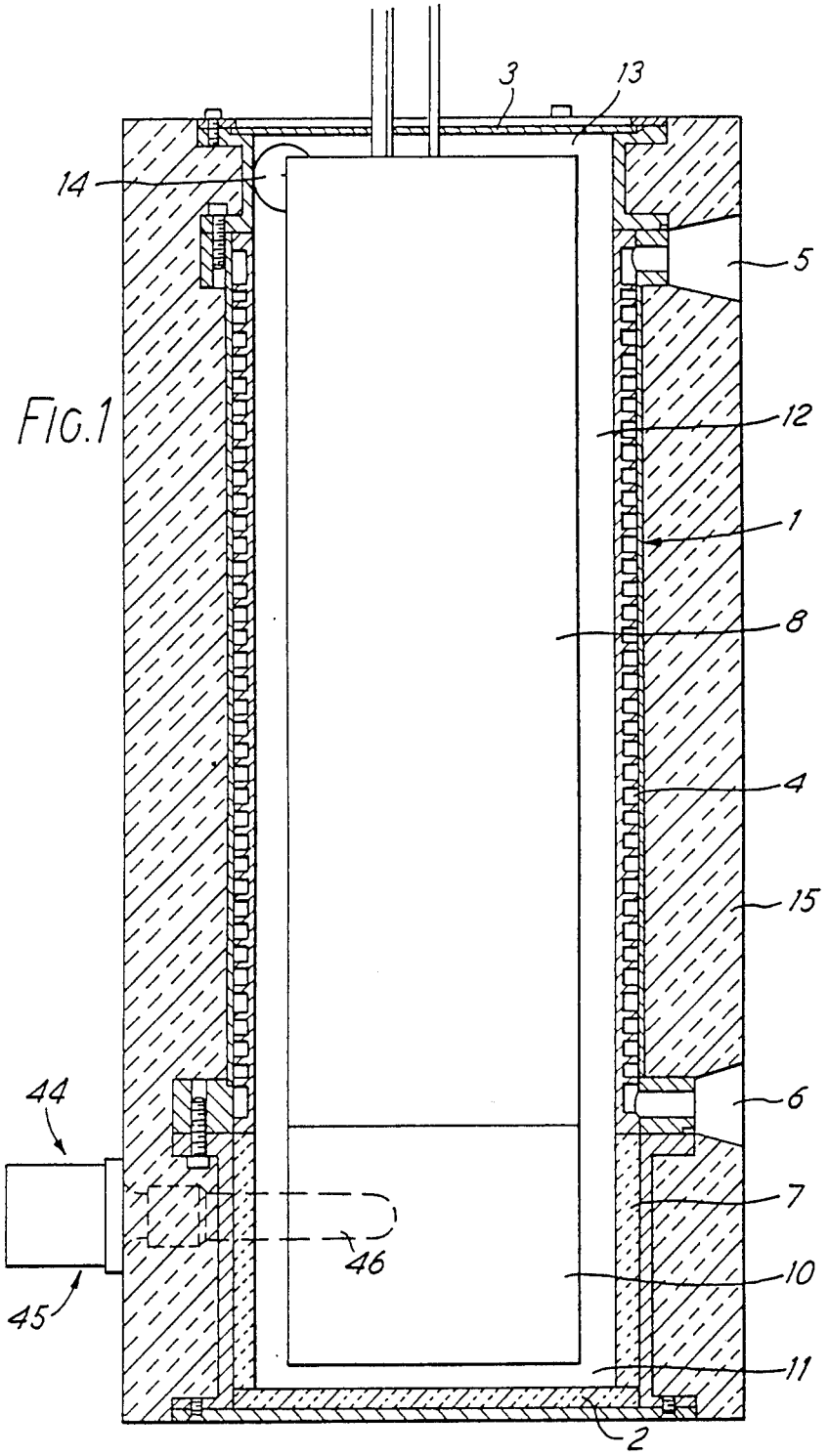

This application is a continuation of application Ser. No. 550,376, filed Nov. 11, 1983 now abandoned.

The invention relates to an apparatus with burner and heat exchanger wherein between a hollow cylinder provided with an end wall and a concentric insert there is formed an annular gap which is free from integers and in which the combustion gases flow from the burner to the outlet.

In a known apparatus of this kind (DE-PS No. 26 24 617), the annular gap is extended by way of the heat exchanger in the hollow cylinder. A burner system serving to supply and mix the fuel feeds fuel and air of combustion substantially tangentially into this annular gap extension. The continuation of the insert forms a cylindrical core of refractory material. The burner can be so designed that the combustion gases initially have a flow velocity of at least 125 m/s. Despite the high velocity, ignition is ensured because a helical flow is developed with superposed jet convolutions. However, difficulties occur upon starting. The flame formed by spark ignition is not very stable and often extinguishes under cooling of the cylindrical core. There are strong pulsations and expulsion of soot and unburnt fuel. It is only when the core and adjacent hollow cylinder have assumed an adequately high temperature that the flame spiral will become sufficiently contracted and the pulsations cease. Another limitation is that a particular minimum power is required to operate the apparatus.

In contrast, the invention is based on the problem of providing an apparatus of the aforementioned kind which permits a starting phase with a pure flame and without pulsations and wherein at the same time the lower power limit can be considerably reduced.

This problem is solved according to the invention in that the end of the insert facing the end wall is provided with an annular end wall and a central burner for gasified liquid or gaseous fuel centrally disposed in the insert, the burner comprising a heatable central fuel preparing chamber and a passage system for the air of combustion with a concentric mouth, and that a burner tube as an extension of the insert terminates at a spacing from the end wall of the hollow cylinder.

In this construction, the fuel can be burnt stoichiometrically free from soot, forms a stable flame free from pulsations and rapidly brings the burner head to high temperatures. This is supported by the heating by which the fuel can for example be brought to high temperatures or vaporise or by which the gaseous fuel-air mixture can also be ignited. The exhaust gases dissipate their heat in the annular gap to the heat exchanger. If very low quantities of fuel are being fired, the flow velocity is correspondingly small and one can dispense with the spiral motion of the gases in the annular gap. If the central burner is only operated at larger amounts of fuel, the combustion gases diverted in the annular gap should have sufficient rotation, which can be brought about by tangential air supply in the passage system of the vapour burner and/or suitable guide blades.

It is favourable if the central burner is a vapour burner in which the fuel preparing chamber is a gasifying tube provided with an electric heating apparatus. Liquid fuel can then be vaporised in the fuel preparing chamber and subsequently burnt stoichiometrically without soot.

A particularly gentle start is produced if in the region of the mouth of the fuel preparing chamber there is provided a glow zone which is made to glow by means of a heating apparatus. When, during starting, the first gaseous fuel is supplied or the first drop of liquid fuel reaches the fuel preparing chamber and is there vaporised, the gas mixes with the air contained in the fuel preparing chamber. The ignitable mixture is ignited at the glow zone. The ignition flame thus formed is pushed out into the interior of the burner tube by the next following fuel gas. It then ignites the mixture formed by the next following fuel gas and the air of combustion supplied through the passage system. This procedure provides reliable ignition and a blue or transparent flame.

It is, however, advisable for the burner tube to consist of a material which assumes a glow temperature during operation of the vapour burner and for a main system serving to supply and mix the fuel to be arranged substantially tangentially to the annular gap at the elevation of the burner tube. When the burner tube glows, the fuel-air mixture feeding the main system is reliably ignited. The flame is stable. There are no pulsations. Since glow ignition takes place at the central burner as well as at the main system, the passage system can open into the chamber within the burner tube and this chamber and the annular gap can be kept free of obstructions for the ignition so that a fully rotationally symmetrical air pattern is produced. The glow zones have the additional advantage that re-ignition occurs within the safety period if the flame is blown off during operation of the central burner as well as the main system. The central burner can, after the starting phase, be kept in operation depending on the type of fuel or is preferably shut off. The two burner systems can therefore be operated simultaneously or independently. When using both burner systems, the apparatus can be operated in a hitherto impossibly large power range so that the modulation zone is doubled. Gaseous or liquid fuel may be employed independently of the amount of fuel. In particular, the main system serving to supply and mix the fuel can also stoichiometrically fire materials which are difficult to burn, for example viscous heating oil, soiled oil or oil-coal mixtures (COM), namely down to a capacity of about 0.1 kg fuel per second, which was hitherto impossible.

Preferably, the burner tube is of a material having a low thermal conductivity. Consequently, the glow temperature is reached after a very short period.

It is also desirable to have guide means for producing an outer annular eddy of flame gases with a return flow path along the inner periphery of the burner tube. This annular eddy protects the freshly formed flame from cooling by the burner head and thereby increases the stability of the initial flame. In addition, it ensures very rapid heating of the burner tube to glow temperature.

The guide means may comprise at least on one side a conical guide wall at the mouth of the passage system so that the air of combustion is introduced as a conical air jet. This jet shape leads to an outer annular eddy which extends beyond the flame front and then circulates back over a comparatively long path along the inner periphery of the burner tube.

It is also favourable if the mouth of the passage system has an axially adjustable gap width. This permits a change in the speed of the air to be supplied.

Further, guide means are advisable with the aid of which the air can be rotatingly supplied to the space within the burner tube. This results in a more stable flame and a more marked outer annular eddy.

In a preferred embodiment, the passage system is designed to produce such an inlet speed of the air into the space within the burner tube and such an inclination determining the inlet angle and rotation that the outer annular eddy surrounds the flame front independently of the amount of fuel fed in. The advantages of the outer annular eddy therefore apply independently of the momentary burner power.

Further, it is advisable to provide a recirculating path through the insert from a chamber preceding the outlet, by way of apertures in the annular end wall to the chamber within the burner tube. In this way, comparatively cold combustion gases are returned to the region of the flame. They do not participate in the combustion but cool the flame. The amount of recirculated exhaust gas is self-regulating, i.e. a function of the amount of fuel introduced. The danger of forming an excessively large amount of nitrogen oxide is therefore reduced.

In particular, the insert may be a hollow cylinder surrounding the central burner. The recirculating combustion gas therefore cools the insert of which the outside is in contact with hot combustion gases.

If the supply of fuel and air of combustion to the central burner and/or main system is regulatable, the respective heat output can be adapted within a very large range to the respective amount of heat that is momentarily required.

Further, one can ensure that the central burner and the main system be operable with different fuels.

Figure 2:
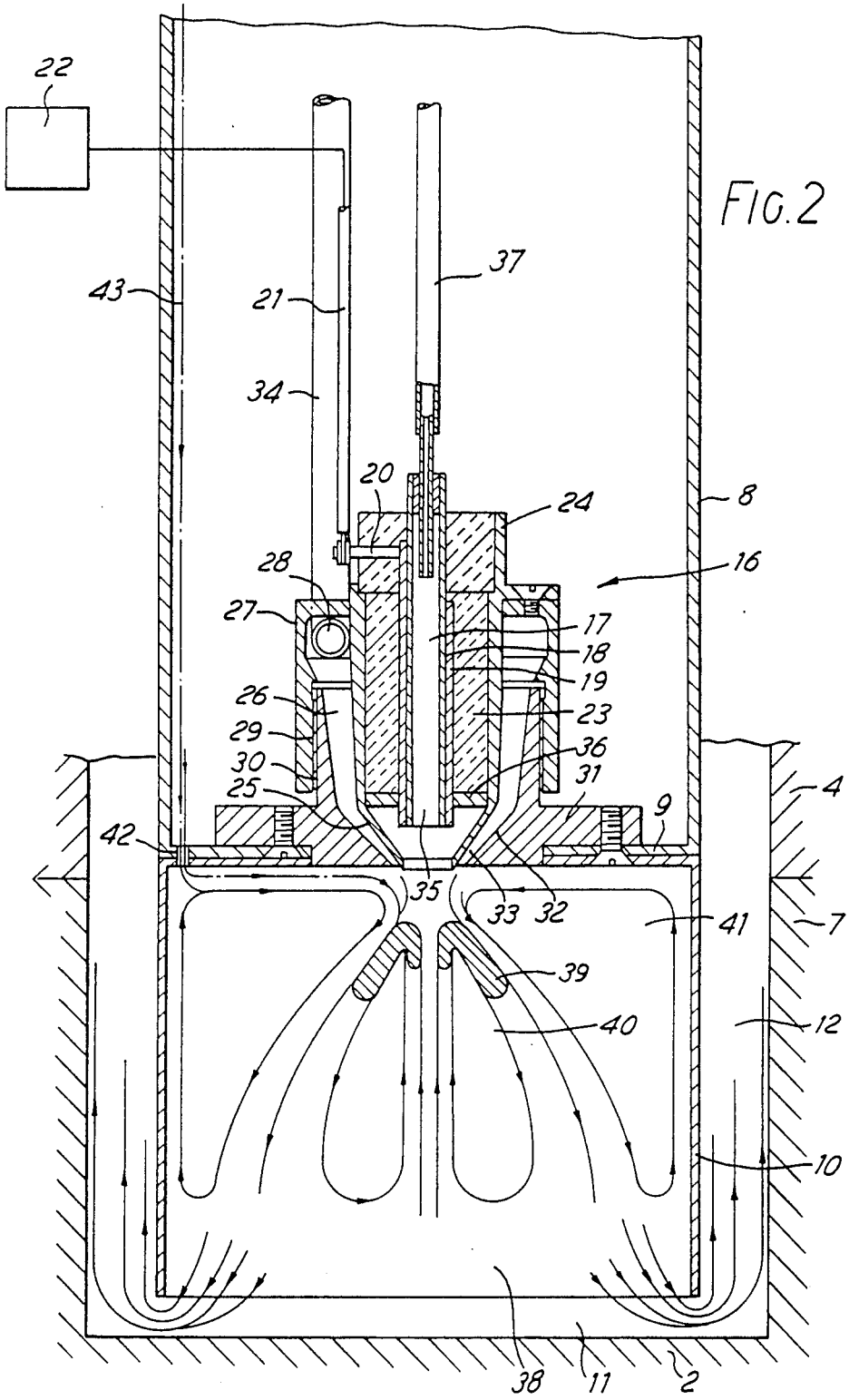

A preferred example of the invention will now be described in more detail with reference to the drawing, wherein:

FIG. 1 is a part longitudinal section through an apparatus of the invention; and FIG. 2 is a partial longitudinal section through the lower part of the apparatus.

A hollow cylinder 1 provided at the bottom with an end wall 2 and at the top with a cover 3 is over the greater part of its length formed by a heat exchanger 4 with inlet 5 and outlet 6 and in the lower portion by a wall 7 of refractory material. A thin-walled hollow cylindrical insert 8 concentric within the hollow cylinder 1 is closed at the bottom by an annular end wall 9 and is associated with an extension in the form of a burner tube 10. The latter terminates at a spacing 11 from the end wall 2. Between the hollow cylinder 1 and insert 8 or burner tube 10 there remains an annular gap 12 connected at the top to an outlet 14 by way of an outlet chamber 13. At the level of the burner tube 10, a main system 44 serving to supply and mix the fuel is provided with a fuel preparing element 45 and a tangential passage 46 through which the fuel-air mixture can be fed to the annular gap 12 at a high speed. The combustion or exhaust gases then form closely superposed jet convolutions which lead to an intensive heat transfer in the region of the heat exchanger 4. The entire apparatus is surrounded by thermal insulation 15.

As shown in FIG. 2, a central burner 16 is disposed within the insert 8 following the end wall 9. This burner comprises a fuel preparing chamber 17 in the form of a gasifying tube 18 which can be heated by an electric heating apparatus 19. The latter can be energised by way of terminals 20 and electric leads 21 from a switching apparatus 22. The gasifying tube 18 and heating apparatus 19 are provided with thermal insulation 23. The whole is held in a housing 24 having a conical wall 25 at the front. The housing 24 at the same time forms the inner boundary of a passage system 26 for the supply of air of combustion bounded at the outside by a wall 27 with a tangential air inlet aperture 29 and an end portion 30 connected thereto by way of a screw-thread 29. The end portion has a flange 31 for securing to the annular end wall 9 and a conical surface 32. The two conical faces 25 and 32 bound an annular gap 33 through which the air of combustion supplied through a tube 34 and the passage system 26 leaves as a rotating conical jet.

At the front end of the gasifying tube 18 there is a glow zone 35 which is produced because a ring 36 more severely prevents the dissipation of heat at the heating apparatus 19 than does the thermal insulation 23 and also because the heating apparatus 19 has a higher energy output in this zone. This can, for example, take place in that the heating apparatus 19 has the form of a sleeve which is slotted several times from both sides and has one throughgoing slot, so that there is a higher resistance at the front end. When liquid fuel is supplied through a conduit 37, vaporisation takes place in the gasifying tube 18. The resulting fuel gas mixes in the combustion chamber 38 with the air of combustion supplied through the annular gap 33 and forms a burnable mixture. A flame front 39 is produced. By reason of the supply of the air of combustion, there is also formed an inner annular eddy 40 and an outer annular eddy 41. The latter is released from the outer layer of the flame front and extends backwards along the burner tube 10 through a considerable distance and then inwardly where the recirculating parts are mixed with the flame again. This outer annular eddy 41 protects the flame from initial cooling by the burner tube 10 and very rapidly heats it to glow temperature.

Upon starting, the first drop of fuel supplied vaporises and mixes with the air contained in the gasifying tube 18. The burnable mixture thus formed is ignited at the glow zone 35. The resulting ignition flame is pushed into the combustion chamber 38 by the next following fuel gas. Together with the air of combustion supplied through the annular gap 33, the next following gas forms a mixture which is ignited by the ignition flame. This results in a very gentle starting procedure without pulsations. The fuel and air can be mixed to result in stoichiometric combustion without the formation of soot.

The burner tube 10 is not only heated internally but also from the outside by the combustion gases deflected in the annular gap 12. Similarly, the wall 7 is heated by radiation from the burner tube 10 and by the combustion gases so that this wall can also soon assume the flow temperature. If, now, the main system 44 for supplying and mixing the fuel is switched on, one obtains right from the start reliable ignition, complete combustion with a transparent blue flame, and operation without pulsations. Depending on the required power, the central burner 16 and main system 44 can be operated alone or together.

Further, the annular end wall 9 is provided with a number of apertures 42 creating a recirculation path 43 from the chamber 13 through the insert 8 and along the end wall 9 to the root of the flame front 39. This leads to cooling of the flame and thus a reduction in the formation of harmful substances. The size of the annular gap 33 can be altered by turning the wall 27 on the end portion 30 so as to set optimum conditions in the combustion chamber 38. This recirculating flow is maintained even when the central burner 16 is switched off.

The recirculation path 43 then extends along the inside of the burner tube 10 and reaches the annular gap 12 from below.

The burner tube 10 can be of steel or a thin-walled ceramic material. The fuel preparing chamber 12 preferably has a wall of silicon carbide which is sealed with silicon gas or some other ceramic material. The other parts used must also be selected so that they are compatible with the temperatures occurring during operation.

I claim:

1. A burner and heat exchanger combination comprising first means defining a hollow cylinder having a first end, a second end and a cylindrical wall extending between the ends of the cylindrical wall, said first means including a heat exchanger that in part is defined by said cylinder wall, an end wall closing the first end of the cylinder wall, a cylindrical shaped shell insert within the cylinder wall in concentric spaced relation thereto to provide an annular gap therewith and having a first terminal end spaced from said end wall to provide a fluid passage space from within the insert to said gap and an opposite end, a transversely extending partition having a combustion chamber side and an opposite housing chamber side, said transversely extending partition being joined to said insert between the ends of the insert, the insert and partition providing a combustion chamber that opens toward said end wall and a housing chamber on the opposite side of the partition from the combustion chamber, said partition having a central opening, said insert having a burner tube extending between said partition and said first terminal end, a central starting phase vapour burner mounted by the partition to extend toward the insert opposite end, said vapour burner including a gasifying tubular member forming a central fuel preparing chamber and having a discharge mouth in proximity to said partition central opening, heating apparatus for heating said tubular member, means forming an air passage system which surround said tubular member and has an annularly shaped mouth in fluid communication with said combustion chamber through said partition central opening for supplying air of combustion to the combustion chamber, tube means for admitting drops of liquid fuel to said fuel preparing chamber remote from the tubular member mouth, means closing said fuel preparing chamber to the admission of fluids thereto other than through said tubular member mouth and tube means, said tubular member mouth serving to admit air to said fuel preparation chamber during start up and to expel a fuel mixture from said fuel preparation chamber during start up, said tubular member having a glow zone adjacent to the tubular member mouth that is heated by said heating apparatus for igniting said expelled fuel mixture, and an operating phase main fuel and air supply system for supplying a fuel-air mixture between the insert and cylinder wall adjacent to the burner tube, said first means having an outlet adjacent to its second end opening to the gap.

2. Apparatus according to claim 1 wherein the means forming an air passage system includes guide means for introducing air into the combustion chamber as a conical jet and producing an outer annular eddy of flame gases having a return flow path along the inner periphery of said burner tube.

3. Apparatus according to claim 1 wherein said operating phase main fuel and air supply system includes a substantially tangential passage for discharging a fuel gas mixture to said gap.

4. Apparatus according to claim 3 wherein the ignited expelled fuel mixture produces a flame front in the burner tube and the means for forming an air passage system includes means for rotatingly supplying air to the combustion chamber at an air speed and an inclination to produce an outer annular eddy of flame gases having a return flow path along the inner periphery of said burner tube and surround the flame front.

5. Apparatus according to claim 3 wherein the burner tube is made of a material which is heatable to a flow temperture during operation of the vapor burner.

6. Apparatus according to claim 3 wherein the partition has peripheral apertures to provide a recirculation path from the housing chamber to the combustion chamber and thence through the annular gap back to the housing chamber.

7. Burner apparatus comprising an axially elongated heat exchanger that includes an axially elongated inner peripheral cylindrical wall having a first end, a second end and an outlet adjacent its second end, an end wall closing the cylindrical wall first end, an axially elongated cylindrical shaped insert having a first end adjacent to said outlet and a second end, a burner tube having a first end joined to the insert second end and a second end adjacent to, but axially spaced from said end wall, said insert and burner tube being mounted within the cylindrical wall in concentric relationship thereto to provide a structural free annular gap that extends from adjacent the burner tube second end to the outlet, an operating phase main fuel and air supply system located adjacent to the cylindrical wall for supplying a fuel air mixture and having a passageway for discharging the fuel air mixture tangentially to said gap adjacent to the burner tube, an annular wall within the insert and joined to the insert adjacent to the burner tube, the annular wall having a central opening that opens therethrough, a burner centrally located in the insert adjacent to the annular wall and having means forming a heatable fuel preparation chamber that has an outlet adjacent to said opening, and means for supplying and discharging combustion air adjacent to the burner outlet to flow through said opening to the interior of the burner tube and thence between the burner tube and end wall to the annular gap, the burner tube being made of a material that during the operation of said burner is heatable to a glow temperature.

8. Apparatus according to claim 7 further characterized in that said annular wall has an aperture radially intermediate the central opening and the cylindrical insert to provide a recirculation path from within the insert and through the aperture to the interior of the burner tube, thence between the burner tube and the end wall to said annular gap and from the annular gap back to the interior of the insert.

9. Apparatus according to claim 7 wherein the burner includes a gasifying tubular member forming a central fuel preparing chamber and having a discharge mouth in proximity to the annular wall opening, and the means for supplying and discharging combustion air adjacent to the burner includes means for surrounding said tubular member and discharging air into the burner tube interior for producing an outer annular eddy of flame gases having a return flow path along the inner periphery of the burner tube.

10. Apparatus according to claim 7 wherein the burner includes a gasifying tube having a discharge end portion and means for electrically heating said gasifying tube, the gasifying tube discharge end portion having a glow zone that glows when heated by said heating means to ignite fuel that passes through said discharge end portion, and that there is provided means for supplying fuel to the gasifying tube.

11. Apparatus according to claim 10 wherein the means for supplying fuel to the gasifying tube supplies a fuel different from the fuel that is a part of the fuel air mixture supplied by the operating phase main fuel and air supply system.

12. Burner apparatus comprising an axially elongated hollow cylinder wall having a first end, a second end and an outlet adjacent to the cylinder wall second end, a cover joined to the cylinder wall second end, an end wall closing the first end of the cylinder wall, an axially elongated cylindrical shaped shell insert within the cylinder wall in concentric spaced relation thereto to provide an annular gap therewith and having a first terminal end spaced from said end wall to provide a fluid passage from within the insert to said gap and through the gap to said outlet, the insert having a second end adjacent to the outlet, a transversely extending partition joined to said insert to provide a combustion chamber that opens toward said end wall and a housing chamber on the opposite side of the partition from the combustion chamber, said partition having a central opening, said insert having a burner tube extending between said partition and the insert first end, means mounted on the partition and extending within the housing chamber for supplying fuel and combustion air to flow through the partition opening and igniting the above mentioned fuel to burn in the combustion chamber, the combustion gases in the combustion chamber resulting from burning flowing between the insert first end and the end wall to the annular gap and then throught the annular gap to the outlet, and a supply system for supplying a fuel-air mixture and discharging said fuel-air mixture to the annular gap adjacent to the burner tube.

13. The apparatus of claim 12 further characterized in that the means mounted on the partition includes a gasifying tube having a discharge end portion adjacent to said opening, means for supplying a gasifiable fuel to the gasifying tube, means for heating said gasifying tube, the gasifying tube discharge end portion having a glow zone that glows when heated by said heating means to ignite the fuel supplied to the gasifying tube, means mounted by the partition and extending within the housing chamber for mounting the gasifying tube and heating means and supplying and discharging combustion air adjacent to the gasifying the discharge end to flow through said opening to the combustion chamber, the burner tube being made of material that during operation of the means mounted on the partition is heatable to a glow temperature to ignite the fuel-air mixture supplied by the supply system.

14. The apparatus of claim 12 in combination with an axially elongated heat exchanger that forms a part of the cylinder wall and has an inlet and an outlet, the space radially between the cylinder wall and insert being free of structure from one end of the insert to the other, the partition having an aperture to provide a recirculation path from the combustion chamber, then between the insert first terminal end and the end wall to said gap, thence through the gap to the housing chamber, and from the housing chamber through the aperture to the combustion chamber, the means mounted on the partition including a central burner located within the housing chamber and having an outlet adjacent to the partition opening, and means for discharging air adjacent to the burner outlet to flow through the partition opening and into the combustion chamber as a rotating conical jet, and the supply system including a tangential passage opening to the annular gap.

15. The apparatus of claim 12 further characterized in that the burner tube is made of a material that during operation of the means mounted on the partition is heatable to a glow temperature to ignite the fuel-air mixture supplied by the supply system and upon being heated to a glow temperature will continue to ignite the mixture supplied by the supply system after discontinuance of operation of the means mounted on the partition.

* * * * *